US007462076B2

(12) United States Patent
Walter et al.

(10) Patent No.: US 7,462,076 B2
(45) Date of Patent: Dec. 9, 2008

(54) TERMINAL BLOCK FOR CONNECTING ELECTRICAL CONDUCTORS

(75) Inventors: Frank Walter, Blumberg (DE); Hermann Stadler, Donaueschingen (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 11/730,740

(22) Filed: Apr. 3, 2007

(65) Prior Publication Data

US 2008/0032566 A1 Feb. 7, 2008

(30) Foreign Application Priority Data

Apr. 5, 2006 (DE) ..... 10 2006 016 364

(51) Int. Cl.
*H01R 9/22* (2006.01)

(52) U.S. Cl. ..... 439/709; 439/441; 439/835

(58) Field of Classification Search ..... 439/709, 439/441, 268, 721, 805, 835
See application file for complete search history.

(56) References Cited

U.S. PATENT DOCUMENTS

| | | | | |
|---|---|---|---|---|
| 4,239,924 | A * | 12/1980 | Pretzer et al. | 568/902.2 |
| 5,588,880 | A * | 12/1996 | Wood | 439/709 |
| 5,662,499 | A * | 9/1997 | Strack et al. | 439/709 |
| 5,722,850 | A * | 3/1998 | White | 439/404 |
| 2004/0043670 | A1 * | 3/2004 | Feldmeier et al. | 439/709 |

FOREIGN PATENT DOCUMENTS

| | | |
|---|---|---|
| DE | 37 43 409 | 10/1994 |
| DE | 197 10 306 | 8/1998 |
| DE | 198 03 085 | 8/1999 |
| DE | 40 19 130 | 3/2000 |
| DE | 200 05 129 | 6/2001 |
| DE | 203 01 369 | 5/2003 |
| DE | 102 44 480 | 4/2004 |
| DE | 10 2004 044 889 | 3/2006 |
| EP | 1 240 687 | 9/2002 |
| WO | 02/49158 | 6/2002 |

* cited by examiner

*Primary Examiner*—Michael C Zarroli
(74) *Attorney, Agent, or Firm*—Nath Law Group; Jerald L. Meyer; Sung Y. Chung

(57) ABSTRACT

This invention concerns a terminal block for connecting electrical conductors with a first clamping spring element (20) and a second clamping spring element (30) for clamping the electrical conductors, with the first and the second clamping spring elements (20, 30) being displaced vertically with respect to each other and with the two clamping spring elements (20, 30) being electrically connected to each other whereby the two clamping spring elements (20, 30) are electrically connected via an essentially S-shaped contact element (10) into which the two clamping spring elements (20, 30) can be inserted from one side.

27 Claims, 8 Drawing Sheets

TERMINAL BLOCK FOR CONNECTING ELECTRICAL CONDUCTORS

CROSS-REFERENCE TO RELATED APPLICATION

Figure 1:
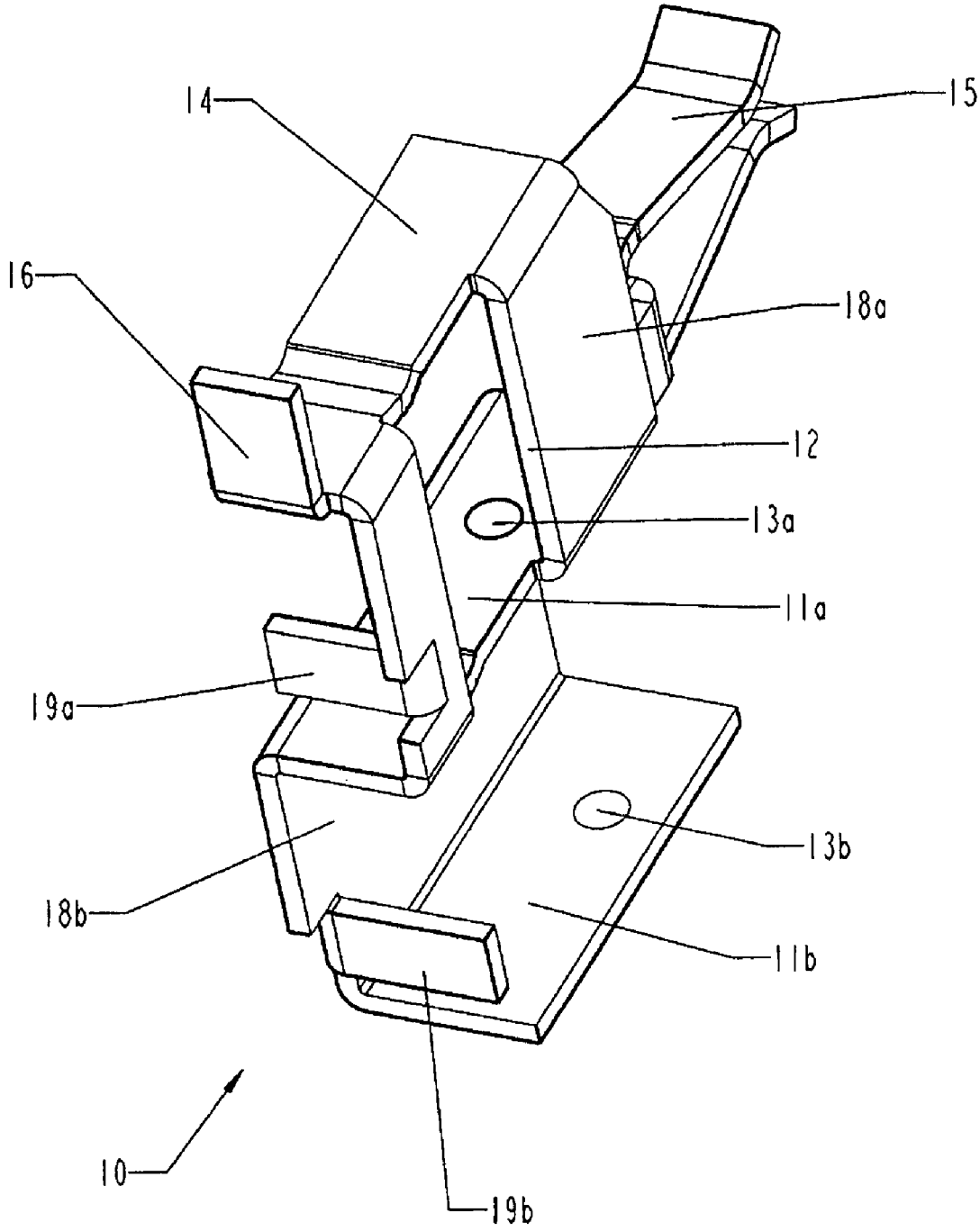

Reference is made to co-pending patent application Ser. No. 11/730,739, which were commonly owned or subject to an obligation of assignment to the same person at the time the present invention was made.

BACKGROUND OF THE INVENTION

1 Field of the Invention

This invention concerns a terminal block for connecting electrical conductors in accordance with the preamble of claim 1.

2 Description of Related Art

DE 197 10 306 A1 discloses a terminal block with two associated clamping points located on top of each other, which are formed by two clamping spring elements formed onto an U-shaped base plate and which are electrically connected to each other. The clamping spring elements are formed by two leaf springs located on the U-shaped base plate, said springs striking the insulating housing of the terminal block. The disadvantage of this terminal block is that the spring forces are transmitted across the plastic of the insulating housing and, since the plastic deforms under large loads, reliable clamping is not ensured after a prolonged period of time. A further disadvantage is that the two clamping points cannot be opened independently. This entails the risk that, on removal of one conductor, the second conductor is also removed.

BRIEF SUMMARY OF THE INVENTION

It is the object of this invention to provide a terminal block with at least two clamping spring elements in which secure clamping of the conductor ends in the clamping points is ensured after a prolonged period of time.

The object of this invention is accomplished by means of a terminal block with the characteristics of claim 1.

Advantageous developments and further embodiments according to the invention are specified in the dependent claims.

In the terminal block according to the invention, the two clamping spring elements are electrically connected via an essentially S-shaped contact element, with each of the two clamping spring elements being insertable into the S-shaped contact element from one side. A clamping effect is thus produced between the clamping spring elements and the S-shaped contact element, so that the clamping spring elements are not fastened to the insulating housing, which consists of plastic, but rather to the S-shaped contact element, which is configured electrically conductive. The spring forces are thus not transmitted across the insulating housing, but rather across the S-shaped contact element. In a preferred embodiment according to the invention, the S-shaped contact element is therefore made of an electrically conductive metal which can absorb the spring forces of the two clamping points without deforming.

The S-shaped contact element is preferably made of one piece, particularly preferably designed as a punched flexural component, whereby the production costs for the S-shaped contact element are reduced.

The first and the second clamping spring element are preferably arranged directly above each other in the S-shaped contact element, without any lateral displacement. A particularly compact arrangement of the two clamping points is thus achieved.

In a particularly preferred embodiment according to the invention, the clamping spring elements are configured as leaf springs, since a leaf spring has the advantage that electrical conductors can be inserted into the clamping points without previously opening the clamping spring elements, so that the connection of the electrical conductor can occur in a particularly simple manner.

The clamping spring elements preferably lie with one contact surface on a contact surface of the S-shaped contact element, so that as large a contact surface area as possible is provided between the clamping spring elements and the S-shaped contact element and a particularly good electrically conductive contact is thus achieved.

In a further particularly preferred embodiment according to the invention, these contact surfaces of the clamping spring elements have a structure with which they form-fit in a correspondingly shaped structure on the contact surface of the S-shaped contact element. This ensures that the clamping spring elements cannot be shifted within the S-shaped contact element when electrical conductors are inserted or removed. Such a form-fitting connection can furthermore be produced in a particularly simple and economical manner.

The terminal block can be produced as a plug-in design or a solderable design. A plug-in contact or a soldering pin is then preferably embodied on the S-shaped contact element so as to produce a particularly good electrical contact.

The S-shaped contact element particularly preferably carries a test surface by means of which it can be determined in a particularly simple manner whether the desired voltage is applied to the S-shaped contact element and thus to the clamping spring elements.

In an advantageous embodiment according to the invention, a first actuator is provided for the first clamping spring element and a second actuator for the second clamping spring element, with the first and the second actuators being independently operable. This makes it possible for each clamping spring element to be opened separately, even with the clamping spring elements being located one above the other, so that the desired conductor can be removed without inadvertently additionally removing the second conductor from the other clamping point.

A particularly simple actuator design is obtained if the first and the second actuators are designed as translational latch elements. Such actuators are particularly easy to construct.

The two actuators are preferably located above the two clamping spring elements and one of the two actuators is guided past the upper clamping spring element so that it can actuate the lower clamping spring element. This provides for a particularly space-saving arrangement of the clamping spring elements and of the actuators.

To enable the terminal block to be configured in an even more compact manner, the S-shaped contact element has, in its upper region, a recess within which the actuator for the lower clamping spring element is guided.

The two actuators are advantageously arranged parallel to each other, whereby a particularly simple constructive layout is obtained.

Each actuator preferably exhibits a contact surface with which it engages a corresponding contact surface of the respective clamping spring element in order to ensure reliable actuation of the clamping spring elements by the actuators.

Each actuator preferably exhibits a pressure surface, on which pressure is exerted for purposes of actuating the respective clamping spring element. For this purpose, the pressure surfaces particularly preferably have a first recess into which the working end of a tool, preferably a screwdriver, particularly preferably a flat-bladed screwdriver, can be inserted. This makes it possible to actuate the actuator even from larger distance with the help of a tool if, for example, it is not possible to actuate the actuator directly with a finger due to the local conditions. In a further advantageous embodiment according to the invention, these first recesses in the pressure surfaces of the two actuators run parallel to each other. This ensures that only the desired actuator is actuated when a screwdriver is inserted and not inadvertently the second actuator as well.

In a particularly advantageous embodiment according to the invention the pressure surface has a second recess whereby, when the pressure surfaces of the two actuators are adjacent, the two second recesses of both actuators are aligned with each other. In this case it is possible to actuate both actuators at the same time by inserting a screwdriver into the second recess, which extends over the two pressure surfaces of both actuators if it should be desired to open both clamping spring elements simultaneously.

The second recesses are preferably positioned perpendicular to the first recesses, since this can be constructively arranged in a particularly simple manner and inadvertent insertion of a screwdriver into the incorrect recess is thus avoided.

In a particularly advantageous further embodiment according to the invention, the first and the second clamping spring element are located in a shared clamp housing, which contains at least two plug-in openings for inserting electrical conductors. The clamp housing serves the purpose of insulating the clamping spring elements. The clamp housing particularly preferably contains a plurality of first and second clamping spring elements in order to make it possible to house a plurality of clamping spring elements as compactly as possible. In this case, the individual clamping spring pairs consisting of a first and a second clamping spring element are preferably electrically insulated from each other so that it is ensured that only the clamping spring elements lying directly above each other are electrically connected with each other while the clamping spring elements lying next to each other are insulated from each other.

In an advantageous embodiment according to the invention, the actuators can be assembled in the clamp housing by using openings, wherein they demonstrate detents by means of which they lock into the clamp housing. This makes the assembly of the terminal blocks and the actuators particularly simple.

The clamp housing preferably has a test opening, through which the test surface of the S-shaped contact element is accessible.

In an advantageous further embodiment according to the invention, a graphic symbol, which enables the actuator to be correlated with the respective clamping spring element, is respectively located on the clamp housing in the proximity of or on the actuator element and in the proximity of the plug-in opening of the corresponding clamping spring element.

BRIEF DESCRIPTION OF THE SEVERAL VIEWS OF THE DRAWING(S)

Figure 2:
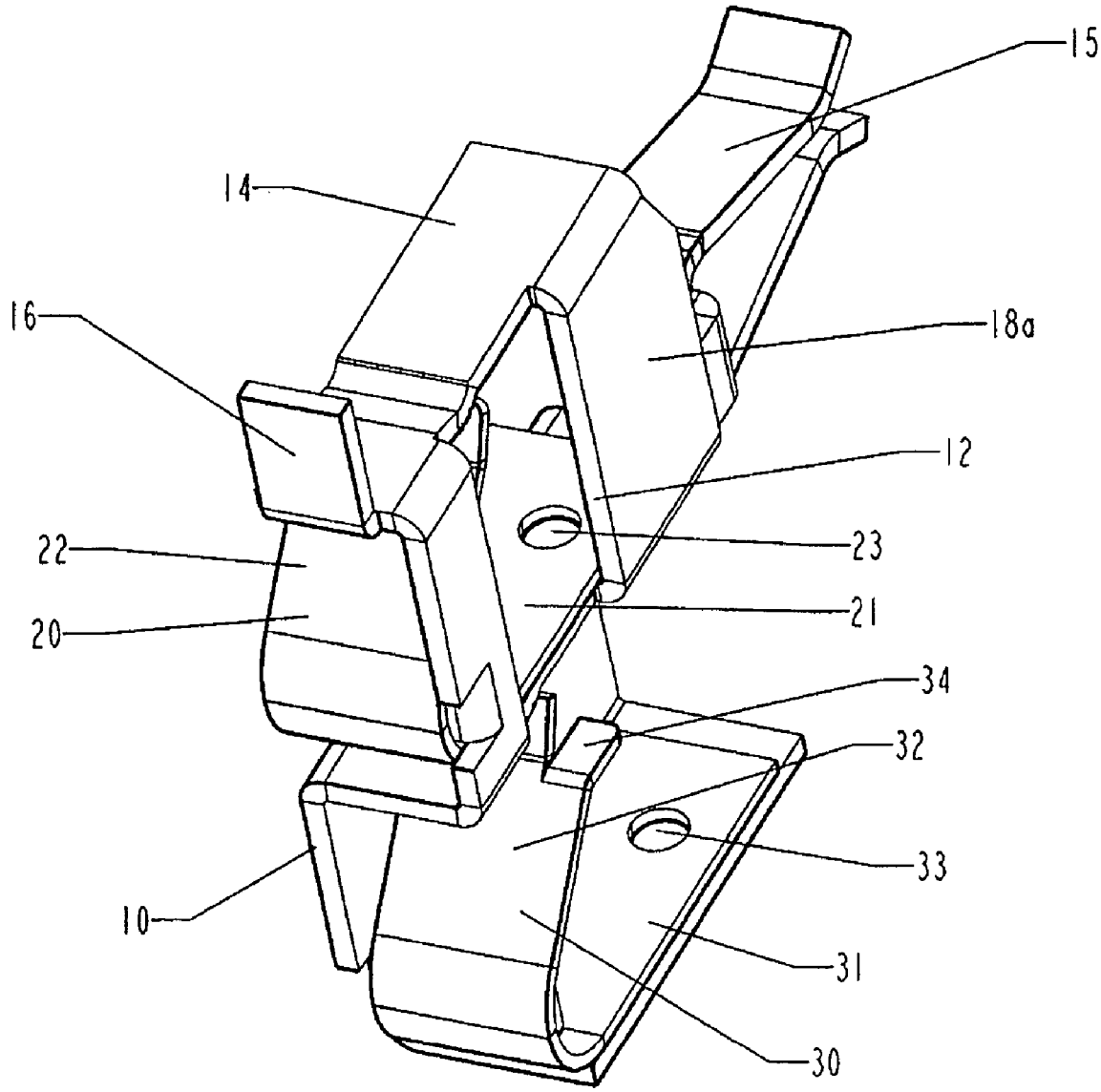
Figure 3:
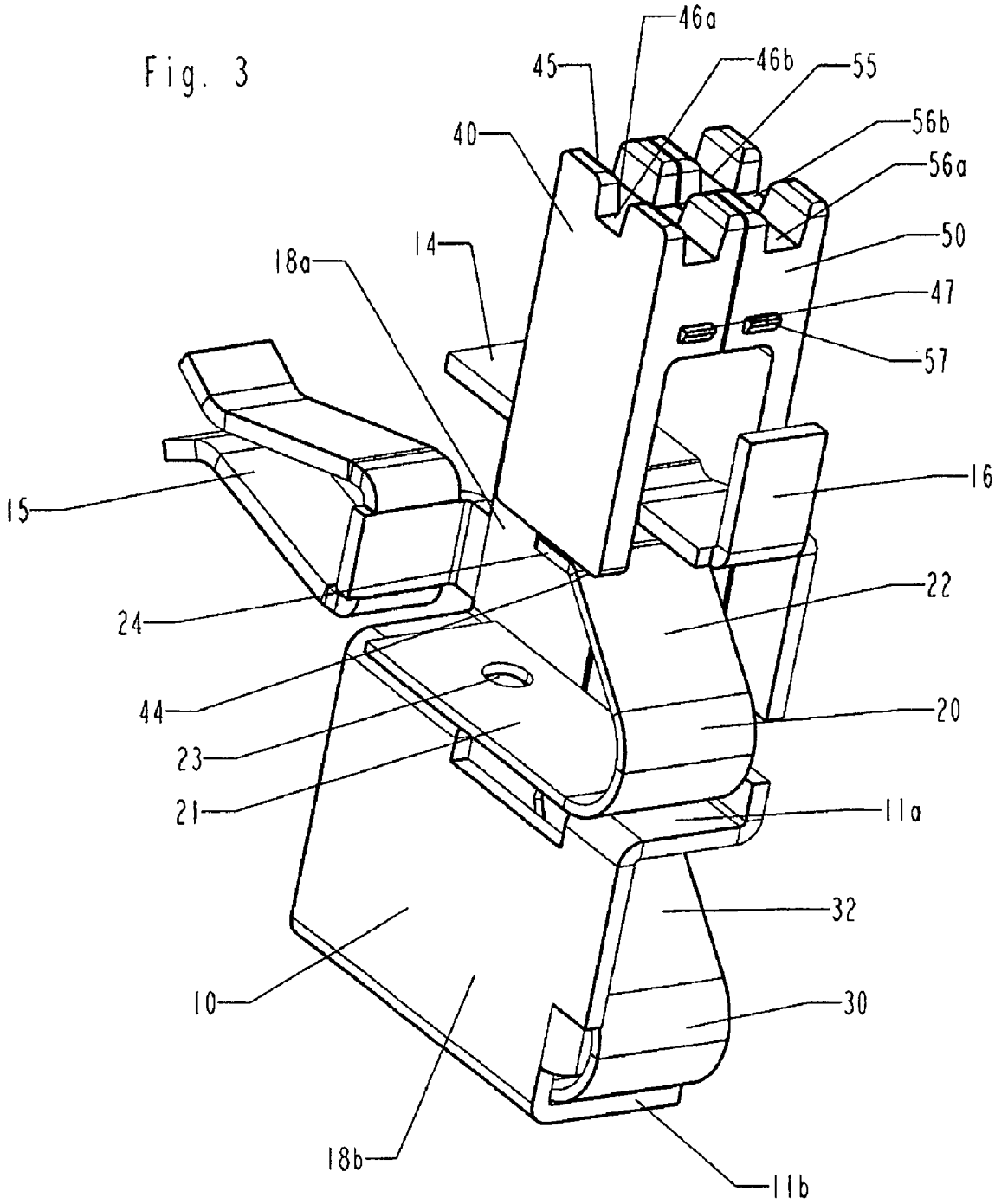
Figure 4:
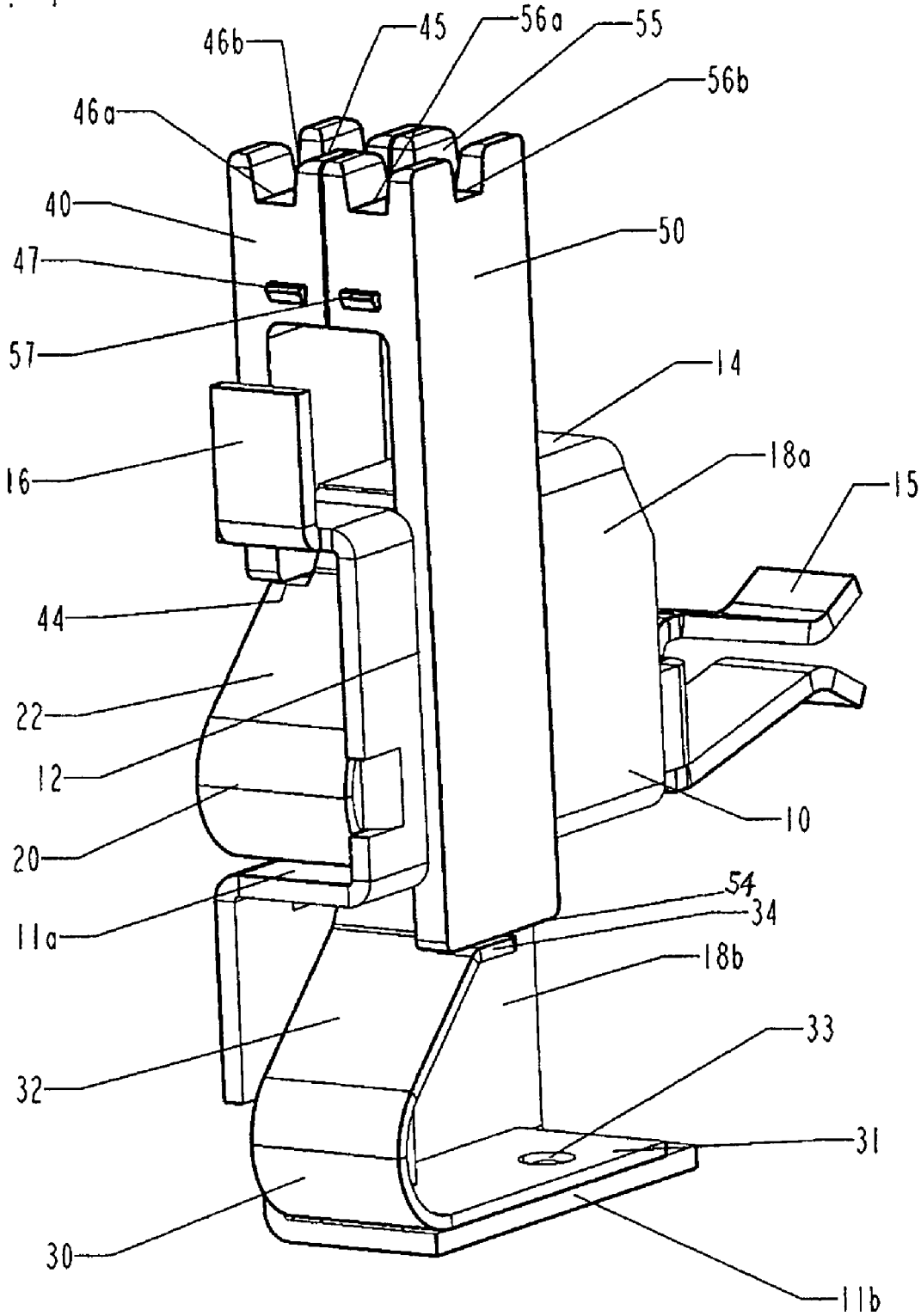
Figure 5:
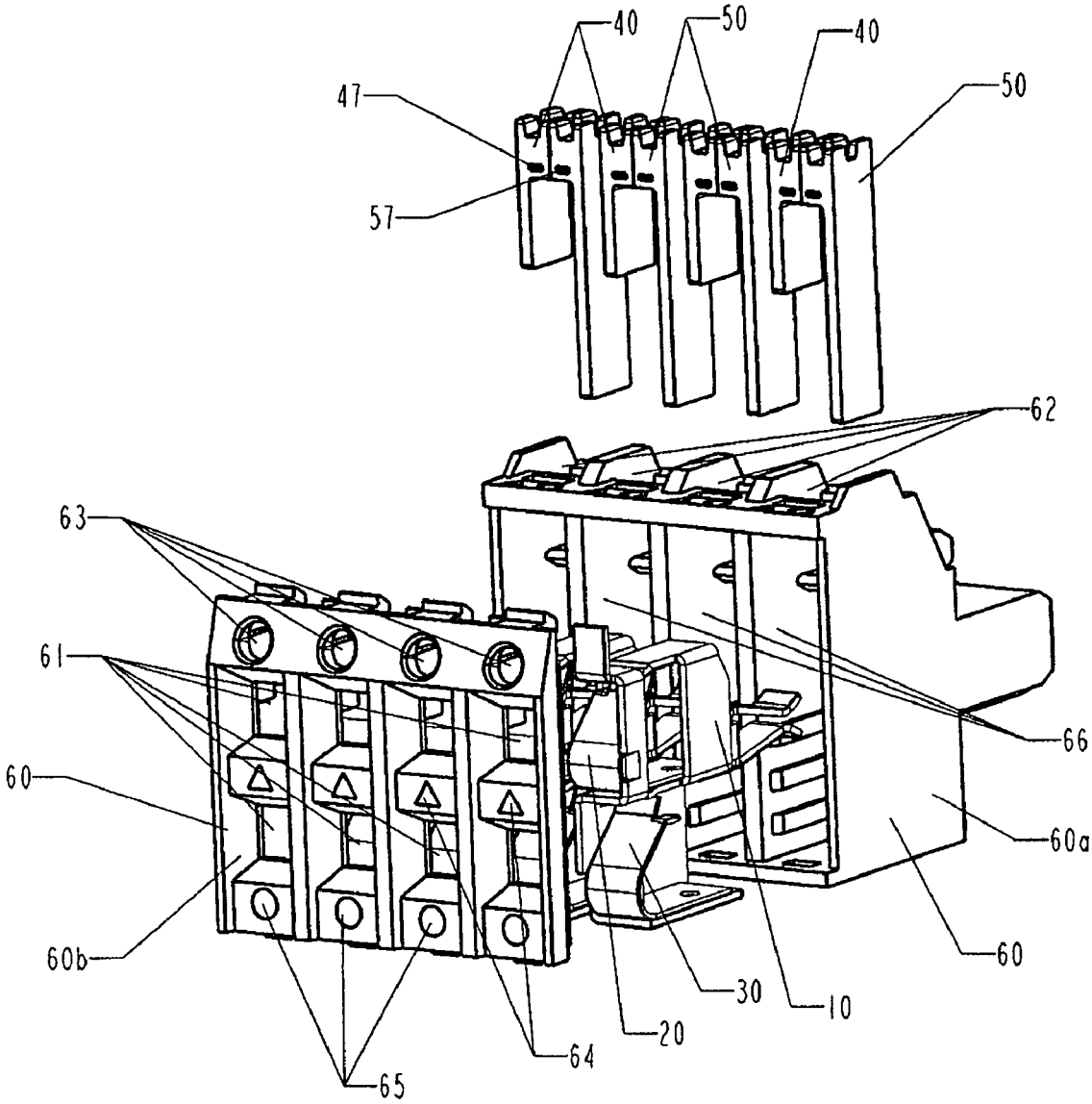
Figure 6:
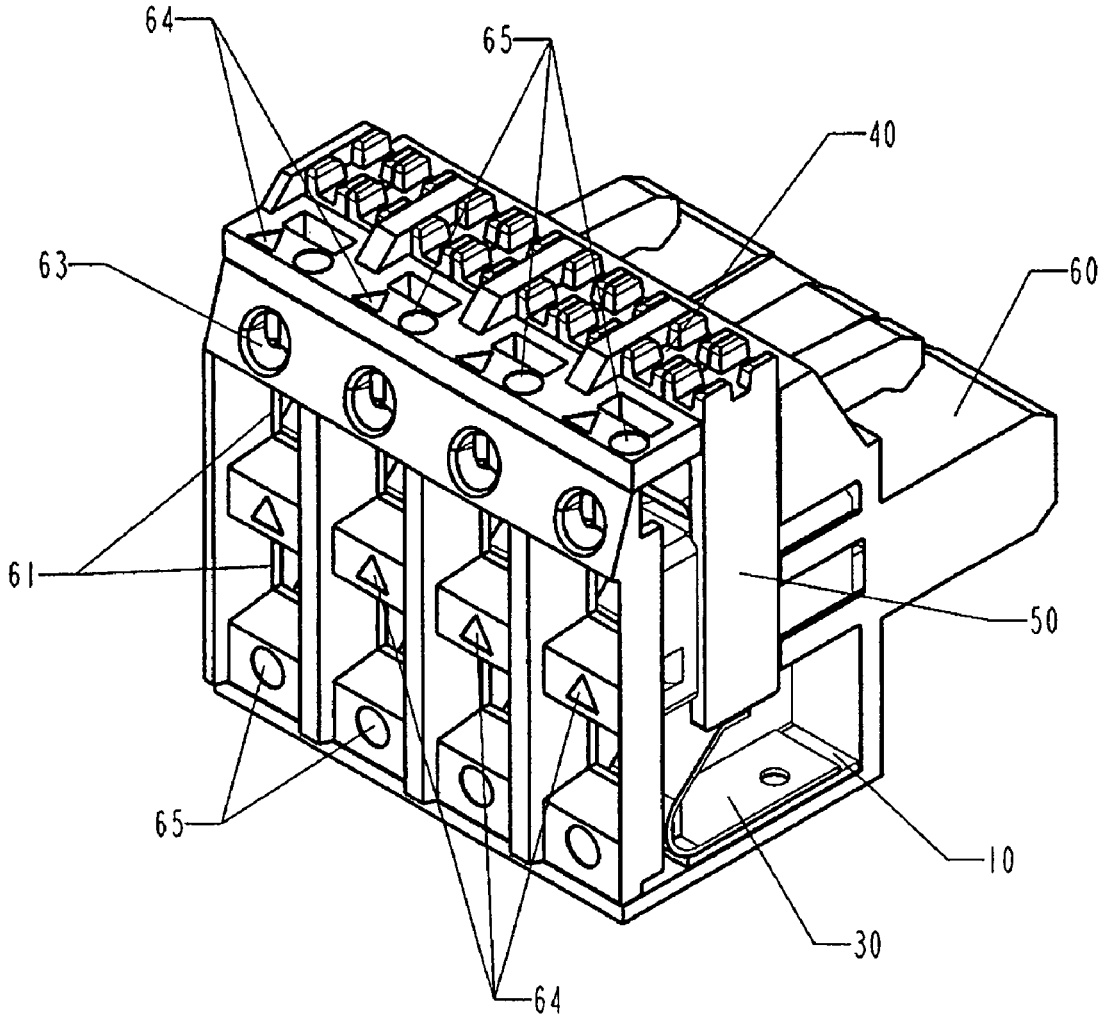
Figure 7:
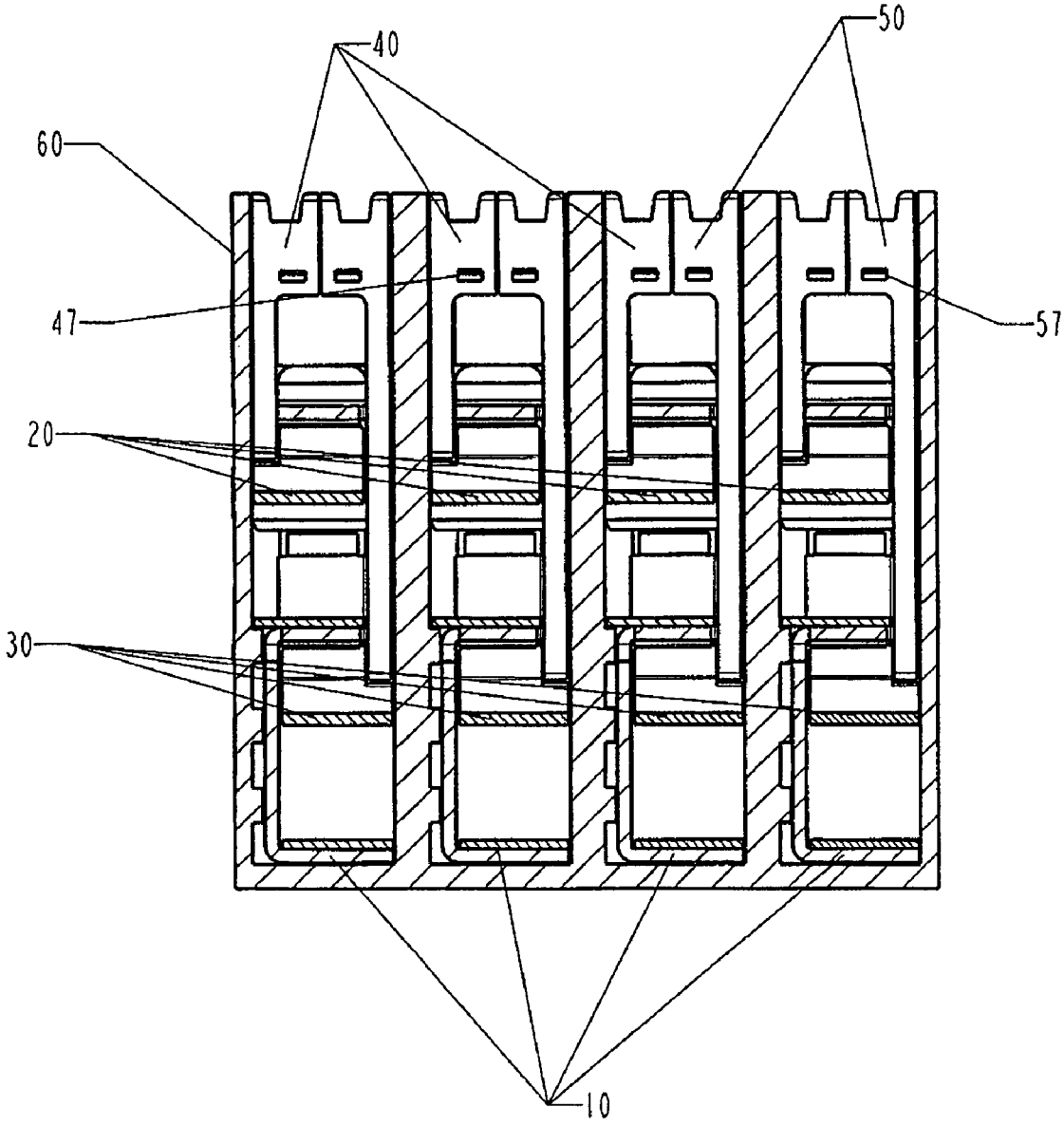
Figure 8:
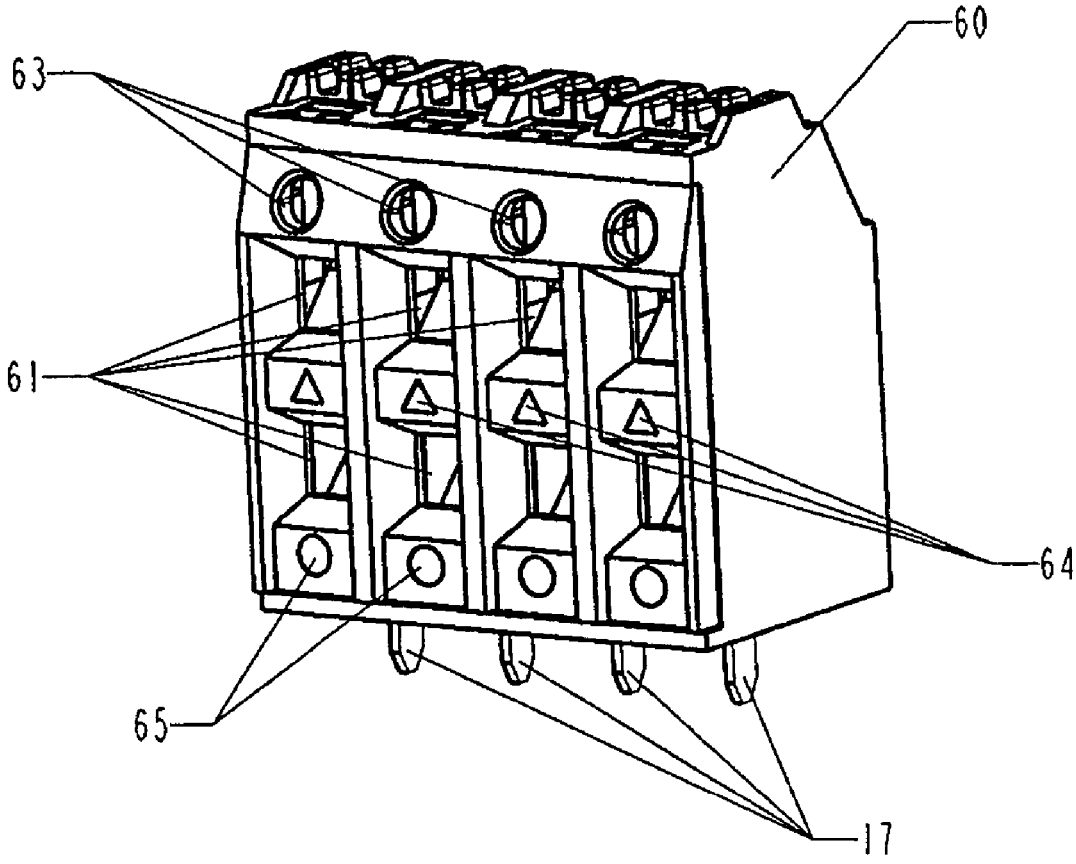

This invention is described in detail using the following figures, which show:

FIG. 1 a perspective view of an example embodiment of an S-shaped contact element, FIG. 2 a perspective view of the S-shaped contact element in accordance with FIG. 1 with inserted clamping spring elements, FIG. 3 a first perspective view of the S-shaped contact element in accordance with FIG. 1 with inserted clamping spring elements and actuators, FIG. 4 a further perspective view of the S-shaped contact element in accordance with FIG. 3, FIG. 5 a perspective exploded view of a terminal block, FIG. 6 the terminal block in accordance with FIG. 5 in the assembled state, FIG. 7 a longitudinal cross section through the terminal block in accordance with FIG. 6 and FIG. 8 a perspective view of a further example embodiment of a terminal block.

DETAILED DESCRIPTION OF THE INVENTION

FIG. 1 shows a perspective view of an S-shaped contact element 10, in which an upper surface 14, a first contact surface 11*a* and a second contact surface 11*b*, which are each essentially rectangular, are positioned parallel to each other and are respectively connected to each other via an upper side surface 18*a* and a lower side surface 18*b*. The upper side surface 18*a* connects the upper surface 14 and the first contact surface 11*a* along one of its longitudinal edges, while the lower side surface 18*b* connects the first contact surface 11*a* and the second contact surface 11*b* along one of its longitudinal edges, wherein, starting at the first contact surface 11*a*, the side surfaces 18*a*, 18*b* are located at the two opposite longitudinal edges of the first contact surface 11*a*. This results in the essentially S-shaped configuration of the S-shaped contact element 10. The S-shaped contact element 10 can be produced particularly economically as a single piece punched flexural component. The S-shaped contact element 10 is in particular made of an electrically conductive metal, the material of the S-shaped contact element 10 being selected so that the electrical conductivity is optimized. The S-shaped contact element 10 is therefore for example made of a copper alloy.

The first contact surface 11*a* and the second contact surface 11*b* respectively contain a first structure 13*a* and a second structure 13*b*, which is for example obtained by means of stamping or punching.

A plug-in contact 15, which can for example be formed by two adjacent leaf springs and which serves the purpose of connecting the S-shaped contact element to a bus bar or the like, is attached to the upper side surface 11*a*.

A test surface 16, which is essentially perpendicular to the upper surface 14, is attached to the upper surface 14. By means of the test surface it can be determined whether a voltage has been applied to the S-shaped contact element 10.

The upper surface 14, the upper side surface 18*a* and the first contact surface 11*a* delimit an upper space within the S-shaped contact element 10, into which a first clamping spring element 20 can be inserted from the open side, i.e. from the side opposite the side surface 18*a*, as shown in FIG. 2. A further lower space, into which space a second clamping spring element 30 can be inserted from the open side, is furthermore delimited within the S-shaped contact element 10 by the first contact surface 11*a*, the lower side surface 18*b* and the second contact surface 11*b* (see FIG. 2). The open side of the lower space is thus located on the side wall of the S-shaped contact element 10 opposite the side of the upper space.

The two clamping spring elements 20, 30 are designed as leaf springs, and each has a contact surface 21, 31 and a spring-loaded leg 22, 32 attached thereto at an acute angle.

The contact surface 21 of the first clamping spring element 20 ends up residing on the first contact surface 11*a* of the S-shaped contact element 10, while the contact surface 31 of the second clamping spring element 30 ends up residing on the second contact surface 11*b* of the S-shaped contact element 10. The spring-loaded leg 22 of the first clamping spring element 20 strikes the inner surface of the upper surface 14 of the S-shaped contact element 10, while the spring-loaded leg 32 of the second contact element 30 rests against the bottom of the first contact surface 11*a* of the S-shaped contact element 10. The longitudinal axes of the clamping spring elements 20, 30 configured as leaf springs run parallel to the longitudinal axis of the upper surface 14, the first contact surface 11*a* and the second contact surface 11*b*. The acute angle of the clamping spring elements 20, 30 is open on the rear side of the S-shaped contact element 10. Two electrical conductors can thus be connected into the S-shaped contact element 10 from the front of the S-shaped contact element 10, said conductors being inserted against the spring force of the spring-loaded leg 22, 32 of the respective clamping spring element 20, 30 into the space delimited by the upper surface 14, the upper side surface 18*a* and the first bearing surface 11*a* or respectively by the first bearing surface 11*a*, the lower side surface 18*b* and the second bearing surface 11*b*. The respective conductor is then clamped between the spring-loaded leg 22 of the first clamping spring element 20 and the upper surface 14 or respectively between the spring-loaded leg 32 of the second clamping spring element 30 and the bottom of the first contact surface 11*a*. The clamping contact is thus established exclusively between metal components, which can absorb the spring forces particularly well.

The clamping spring elements 20, 30 are likewise made of an electrically conductive material, wherein the material can be selected to the effect that the spring-loading properties of the clamping spring elements 20, 30 are optimized, since the electrical contact between the connected conductor and a bus bar or the like is optimized via the configuration of the S-shaped contact element 10.

The two clamping spring elements 20, 30 are located directly above each other in the S-shaped contact element 10, so that the two clamping points formed thereby can be configured to be as compact as possible.

The clamping spring elements 20, 30 have a structure 23, 33 in their contact surface 21, 31, which is for example formed by embossing or stamping. As soon as the respective clamping spring element 20, 30 comes to lie on the corresponding bearing surface 11*a*, 11*b* of the S-shaped contact element 10, this structure 23, 33 engages the corresponding structure 13*a*, 13*b* of the S-shaped contact element 10, whereby the clamping spring element 20, 30 is secured against a displacement on the respective contact surface 11*a*, 11*b* of the S-shaped contact element 10. In addition, a bar 19*a* is attached to the upper side surface 18*a* so that it is perpendicular to the upper side surface 18*a*, so that, on insertion into the space formed by the upper surface 14, the upper side surface 18*a* and the first contact surface 11*a*, the bar 19*a* ends up residing in the apex of the acute angle of the first clamping spring element 20, whereby anchorage in the desired position in the S-shaped contact element 10 is likewise achieved. Similarly a bar 19*b* is attached to the lower side surface 18*b* so that it is perpendicular to the lower side surface 18*b*, whereby on insertion into the space formed by the first contact surface 11*a*, the lower side surface 18*b* and the second contact surface 11*b*, the bar 19*b* ends up residing in the apex of the acute angle of the second clamping spring element 30, whereby the second clamping spring element 30 is also anchored in its position relative to the S-shaped contact element 10. In particular, the bars 19*a*, 19*b* secure the clamping spring elements 20, 30 against a shift of the inserted conductor in the longitudinal direction on insertion of a conductor into the corresponding clamping point.

To enable the two clamping spring elements 20, 30 to be opened independently, for example to be able to again remove an inserted conductor, a first actuator 40 with which the first clamping spring element 20 can be actuated and a second actuator 50 with which the second clamping spring element 30 can be opened are located above the clamping spring elements 20, 30, (see FIGS. 3 and 4). The actuators 40, 50 essentially consist of an elongated rectangular parallelepiped, whose faces have a contact surface 44, 54 for contacting the corresponding clamping spring element 20, 30 and whose opposite faces exhibit a pressure surface 45, 55 for actuating the actuators 40, 50.

The contact surface 44 of the first actuator 40 then engages a contact surface 24 of the first clamping spring element 20, which is located at the free end of the spring-loaded leg 22 of the first clamping spring element 20 and which resides in the open side of the space enclosed by the upper surface 14, the upper side surface 18*a* and the first contact surface 11*a* opposite the upper side 18*a*. The first actuator 40 thus engages beyond the upper surface 14 against the contact surface 24 of the first clamping spring element 20, while the pressure surface 45 of the first actuator 40 lies above the upper surface 14.

The second actuator 50 is configured so that the pressure surface 55 lies above the upper surface 14, with the second actuator 50 engaging beyond the upper surface 14 and the first contact surface 11*a* against the second clamping spring element 30. For this purpose, the second clamping spring element 30 has a contact surface 34, which is located at the free end of the spring-loaded leg 32 of the second clamping spring element 30 and which points to the open side [of the space enclosed] by the first contact surface 11*a*, the lower side surface 18*b* and the second contact surface 11*b* of the S-shaped contact element 10. So that the second actuator 50 can be configured as compactly as possible, the upper region of the S-shaped contact element 10, in particular in its upper side surface 18*a*, has a recess 12 into which the second actuator 50 is guided (see FIG. 4).

The two actuators 40, 50 are thus designed as pressure elements, which can be displaced along their longitudinal axis and thus constitute translational pressure elements. The two actuators 40, 50 can be actuated independently, so that each individual clamping spring element 20, 30 can be opened individually to remove a conductor clamped therein, without the there existing a risk that a conductor held in the other clamping point will also be inadvertently removed.

In principle the two actuators 40 or 50 are actuated by pressure on the pressure surfaces 45, 55 whereby the spring-loaded leg 22, 32 is removed from the corresponding stop face, i.e. the upper surface 14 or respectively the bottom of the first contact surface 11*a*, so that a conductor clamped therein can be removed. The pressure surfaces 45, 55 additionally each have first recesses 46*a*, 56*a*, which run parallel to each other and parallel to the longitudinal axis of the upper surface 14. The first recesses 46*a*, 56*a* are configured so that the working end of a tool, in particular a screwdriver, in particular a flat-bladed screwdriver, can be inserted into the first recess 46*a*, 56*a*. Thus each actuator 40, 50 can also be actuated by inserting the working end of the tool into the corresponding recess 46*a*, 56*a* and by applying pressure on the actuator 40, 50 by means of the tool. This is of particular advantage if the actuators 40, 50 are not directly accessible. So that both actuators 40, 50 can, if desired, also be actuated simultaneously, each of the pressure surfaces 45, 55 has a second recess 46*b*, 56*b*, each of which runs perpendicular to the first recesses 46*a*, 56*a* and they are aligned with each other by the respective pressure surfaces 45, 55. If the two pressure surfaces 45, 55 of the two actuators 40, 50 are immediately adjacent, a flat-bladed screwdriver can be simultaneously applied to both second recesses 46*b*, 56*b*, so that both actuators 40, 50 can actuated simultaneously in a particularly simple manner. If only one actuator 40, 50 is to be actuated, then the flat-bladed screwdriver is turned by 90° and is applied to the first recess 46*a*, 56*a* so there is no risk that the other respective actuator 40, 50 will be actuated at the same time.

FIG. 5 shows an exploded view of a terminal block wherein said S-shaped contact elements 10 as well as the actuators 40, 50 are used. FIG. 6 shows the corresponding terminal block in its assembled state with an open side wall, FIG. 7 a longitudinal cross-section of the terminal block in accordance with FIG. 6. The terminal block in accordance with FIG. 5 has a clamp housing 60, which consists of a base plate 60*a* and a cover component 60*b*. The base plate 60*a* has a plurality of chambers, in particular four chambers 66, into each of which an S-shaped contact element 10, each including a first clamping spring element 20 and a second clamping spring element 30, can be inserted. By placing the S-shaped contact elements 10 in the individual chambers 66, the S-shaped contact elements 10 are insulated from each other, so that only the first and second clamping spring elements 20, 30 located within an S-shaped contact element 10 are electrically connected to each other The base plate 60*a* is closed by the cover component 60*b*, within which a plug-in opening 61 is located in front of each clamping spring element 20, 30, an electrical conductor being insertable into the corresponding clamping point through said plug-in opening. Above the plug-in openings 61, a test opening 63 is positioned so that the test surface 16 of the S-shaped contact element 10 comes to rest behind the test opening 63 and is thus accessible through the test opening 63. Above the S-shaped contact element 10, an insertion opening 62 for each S-shaped contact element 10 is located between the cover component 60*b* and the base plate 60*a*, a first actuator 40 and a second actuator 50 for each chamber 66 being insertable through said insertion opening. So that the actuators 40, 50 stay in the clamp housing 60, each of the actuators 40, 50 has a detent 47, 57, by means of which they lock into the clamp housing 60 after they are assembled into the clamp housing 60 and are thus secured against falling out.

So that it is also evident in the assembled state of the terminal block which clamping spring element 20, 30 can be actuated by means of which actuator 40, 50, a first symbol 64 is located on the exterior of the clamp housing 60 in the proximity of or on the first actuator 40 and in the proximity of the plug-in opening 61 of the first clamping spring element 20, while a second symbol 65 is located in the proximity of or on the second actuator 50 and in the proximity of the plug-in opening 61 of the second clamping spring element 30. The first and second symbols 64, 65 differ from each other. This enables the respective actuator 40, 50 to be correlated with the corresponding clamping spring element 20, 30.

FIG. 8 shows a further embodiment of a terminal block in which the plug contact 15 of the S-shaped contact elements 10 are replaced by a soldering pin 17 attached to the bottom of the second contact surface 11*b*. The terminal block can thus be constructed with both a plug-in and a solderable configuration. The further development of the terminal block in accordance with FIG. 8 corresponds to the of the embodiment described above in FIGS. 1 to 7.

LIST OF REFERENCE CHARACTERS

10 S-shaped contact element
11*a* first contact surface
11*b* second contact surface
12 recess
13*a* first structure
13*b* second structure
14 upper surface
15 plug-in contact
16 test surface
17 soldering pin
18*a* side surface
18*b* side surface
19*a* bar
19*b* bar
20 first clamping spring element
21 contact surface
22 spring-loaded leg
23 structure
24 contact surface
30 second clamping spring element
31 contact surface
32 spring-loaded leg
33 structure
34 contact surface
40 first actuator
44 contact surface
45 pressure surface
46*a* first recess
46*b* second recess
47 detent
50 second actuator
54 contact surface
55 pressure surface
56*a* first recess
56*b* second recess
57 detent
60 clamp housing
60*a* base plate
60*b* cover component
61 plug-in opening
62 insertion opening
63 test opening
64 first symbol
65 second symbol
66 chamber

The invention claimed is:

1. Terminal block for connecting electrical conductors, the terminal block comprising a first clamping spring element (20) and a second clamping spring element (30) for clamping the electrical conductors, with the first and the second clamping spring elements (20, 30) being displaced vertically with respect to each other and with the two clamping spring elements (20, 30) being electrically connected to each other, characterized in that the two clamping spring elements (20, 30) are electrically connected to one another via an essentially S-shaped contact element (10) into which the two clamping spring elements (20, 30) can be inserted from one side.

2. Terminal block according to claim 1, characterized in that the S-shaped contact element (10) is made of an electrically conductive metal.

3. Terminal block according to claim 1, characterized in that the S-shaped contact element (10) is made of one piece.

4. Terminal block according to claim 1, characterized in that the S-shaped contact element (10) is produced as punched flexural component.

5. Terminal block according to claim 1, characterized in that the first and the second clamping spring elements (20, 30) are positioned one above the other.

6. Terminal block according to claim 1, characterized in that the clamping spring elements (20, 30) are configured as leaf springs.

7. Terminal block according to claim 1, characterized in that the clamping spring elements (20, 30) rest against a contact surface (11*a*, 11*b*) of the S-shaped contact element (10) with a contact surface (21, 31).

8. Terminal block according to claim 1, characterized in that a contact surface (21, 31) of the clamping spring elements (20, 30) exhibits a structure (23, 33), with which it form-fits into a correspondingly shaped structure (13*a*, 13*b*) of a contact surface of the S-shaped contact element (10).

9. Terminal block according to claim 1, characterized in that a plug-in contact (15) or a soldering pin (17) is embodied on the S-shaped contact element (10).

10. Terminal block according to claim 1, characterized in that a test surface (16) is located on the S-shaped contact element (10).

11. Terminal block according to claim 1, characterized in that a first actuator (40) is provided for the first clamping spring element (20) and a second actuator (50) for the second clamping spring element (30), whereby the first and the second actuators (40, 50) can be independently actuated.

12. Terminal block according to claim 11, characterized in that the first and the second actuators (40, 50) are designed as translational latch elements.

13. Terminal block according to claim 11, characterized in that the two actuators (40, 50) are located above the two clamping spring elements (20, 30) and one of the two actuators (50) is guided past the upper clamping spring element (20) so that it can actuate the lower clamping spring element (30).

14. Terminal block according to claim 13, characterized in that the S-shaped contact element (10) has, in its upper region (18*a*), a recess (12) within which the actuator (50) for the lower clamping spring element (30) is guided.

15. Terminal block according to claim 11, characterized in that the two actuators (40, 50) are arranged parallel to each other.

16. Terminal block according to claim 11, characterized in that each actuator (40, 50) has a contact surface (44, 54), with which it engages a corresponding contact surface (24, 34) of the respective clamping spring element (20, 30).

17. Terminal block according to claim 11, characterized in that each actuator (40, 50) exhibits a pressure surface (45, 55), on which pressure is applied for purposes of actuating the respective clamping spring element (20, 30).

18. Terminal block according to claim 17, characterized in that the pushbutton (45, 55) has a first recess (46*a*, 56*a*), into which the working end of a tool, preferably a screwdriver, particularly preferably a flat-bladed screwdriver, can be inserted.

19. Terminal block according to claim 18, characterized in that the first recesses (46*a*, 56*a*) in the pressure surfaces (45, 55) of the two actuators (40, 50) run parallel to each other.

20. Terminal block according to claim 17, characterized in that the pressure surfaces (45, 55) have a second recess (46*b*, 56*b*), whereby when the pressure surfaces (45, 55) of the two actuators (40, 50) are adjacent, the two second recesses (46*b*, 56*b*) of the two actuators (40, 50) are aligned with each other.

21. Terminal block according to claim 20, characterized in that the second recesses (46*b*, 56*b*) are perpendicular to the first recesses (46*a*, 56*a*).

22. Terminal block according to claim 1, characterized in that the first and the second clamping spring elements (20, 30) are assembled into a common clamp housing (60), which has at least two plug-in openings (61) for inserting the electrical conductors.

23. Terminal block according to claim 22, characterized in that a plurality of first and second clamping spring elements (20, 30) are located in the clamp housing (60).

24. Terminal block according to claim 23, characterized in that the individual pairs of clamping springs consisting of first and a second clamping spring elements (20, 30) are electrically insulated from each other.

25. Terminal block according to claim 22, characterized in that the actuators (40, 50) can be assembled by using insertion openings (62) in the clamp housing (60) and have a detent (47, 57), by means of which they are locked in the clamp housing (60).

26. Terminal block according to claim 22, characterized in that the clamp housing (60) has a test opening (63) through which the test surface (16) of the S-shaped contact element (10) is accessible.

27. Terminal block according to claim 22, characterized in that a graphic symbol (64, 65), which enables the actuator (40, 50) to be correlated with the respective clamping spring element (20, 30), is located on the clamp housing (60) in the proximity of or on the actuator (40, 50) and in the proximity of the plug-in opening (61) of the corresponding clamping spring element (20, 30).

* * * * *